US006554511B2

(12) United States Patent
Kwasny et al.

(10) Patent No.: US 6,554,511 B2
(45) Date of Patent: Apr. 29, 2003

(54) MEDIA CUTTER AND SLICER MECHANISM FOR A PRINTER

(75) Inventors: David M Kwasny, Corvallis, OR (US); Melissa D. Boyd, Corvallis, OR (US); Lawrence R Plotkin, Corvallis, OR (US); George C Ross, Philomath, OR (US); Emily B. Winston, Old Bridge, NJ (US)

(73) Assignee: Hewlett-Packard Development Co., Houston, TX (US)

( * ) Notice: Subject to any disclaimer, the term of this patent is extended or adjusted under 35 U.S.C. 154(b) by 67 days.

(21) Appl. No.: 09/795,259

(22) Filed: Feb. 27, 2001

(65) Prior Publication Data

US 2002/0118990 A1 Aug. 29, 2002

(51) Int. Cl.[7] ..... B41J 11/66

(52) U.S. Cl. ..... 400/621; 400/621.1; 83/408; 83/598; 234/42

(58) Field of Search ..... 400/621, 621.1; 234/42, 43, 46; 83/408, 598, 599, 600, 602

(56) References Cited

U.S. PATENT DOCUMENTS

| | | | | | |
|---|---|---|---|---|---|
| 4,157,672 | A | | 6/1979 | Frye | 83/500 |
| 4,216,686 | A | | 8/1980 | Stoffels | 82/53 |
| 4,420,996 | A | | 12/1983 | Greding et al. | 83/13 |
| 4,459,888 | A | | 7/1984 | Frye | 83/507 |
| 4,537,582 | A | | 8/1985 | Liu | 493/38 |
| 4,701,063 | A | * | 10/1987 | Wysk et al. | 101/226 |
| 4,784,318 | A | * | 11/1988 | Bay | 234/2 |
| 5,003,856 | A | * | 4/1991 | Fujimura et al. | 83/576 |
| 5,120,290 | A | * | 6/1992 | Bay | 493/14 |
| 5,357,731 | A | * | 10/1994 | Conway et al. | 493/208 |
| 5,358,187 | A | * | 10/1994 | Ward | 241/101.4 |
| 5,360,161 | A | * | 11/1994 | Schaller et al. | 234/42 |
| 5,367,934 | A | | 11/1994 | MacNiel | 83/42.5 |
| 5,671,065 | A | * | 9/1997 | Lee | 101/93.07 |
| 5,911,530 | A | * | 6/1999 | Hinojosa et al. | 400/621 |
| 6,092,802 | A | * | 7/2000 | Lackner et al. | 271/184 |
| 6,170,943 | B1 | | 1/2001 | Wen et al. | 347/101 |
| 6,267,034 | B1 | * | 7/2001 | Beckwith | 101/226 |
| 6,296,103 | B1 | * | 10/2001 | Gross | 198/429 |

OTHER PUBLICATIONS

Product flyer for "Slitter Module" of Azco (printed from web 1998).
Product flyer for "Trimming & Slitting Machines" of McBride Machine Division (printed from web 1998).
Product flyer for "Slitter & Perf Wheel Holders" of FPMI (printed from web 1998).
Product flyer for "The Trim & Cut Work Station" of ICD (printed from web 1998).
Product flyer for "Lucht's Automatic Package Cutter" of Lucht Engineering, Inc. (Apr. 1990).

* cited by examiner

*Primary Examiner*—Andrew H. Hirshfeld
*Assistant Examiner*—Dave A. Ghatt

(57) ABSTRACT

A printer for creating specialty-sized prints includes a printing mechanism, a cutter mechanism and a slicing mechanism. A media web or sheet is fed into the printer and is advanced by a media advancement mechanism in a media advancement direction. The cutter mechanism cuts the media transverse to the media advancement direction. The slicing mechanism slices the media parallel to the media advancement direction. The slicing mechanism includes a cam positioned on a camshaft and a slicer module. The slicer module is positioned adjacent the camshaft and includes a contact spring operatively spaced from the cam and a blade operatively spaced from the media. The media is sliced when an actuation mechanism rotates the camshaft so the cam pushes against the contact spring of the slicer module, which biases the blade against the media.

24 Claims, 3 Drawing Sheets

MEDIA CUTTER AND SLICER MECHANISM FOR A PRINTER

TECHNICAL FIELD

The present invention relates generally to printers, and more particularly, to a system and method for intermittently and individually slicing and cutting printed media at selected positions to create specialty-sized prints.

BACKGROUND ART

Typically, printed media, especially photographic printed media, must be trimmed to create a specialty-sized print. Generally, photographic printer outputs are trimmed offline to specialty-sizes, for example, 4×6-inch prints, 5×7-inch prints, 4×10-inch prints, or 8×10-inch prints. In one known method, all prints of one size are printed and cut from a media roll of a desired width. For example, if a 4×6-inch print is desired, then a media roll having a width of four inches may be used. The media is then transversely cut every six inches such that a plurality of 4×6-inch prints are produced. However, for each specialty-sized print a new media roll is required, and hence, the method is expensive and lacks versatility. Moreover, when using a small specialty-sized roll, as for example, the media roll having a width of four inches, the print speed and throughput of the equipment is lower than equipment which is capable of producing double prints across a media roll.

Accordingly to provide specialty-sized prints in a printer, it would be desirable to perform both slices and cuts online. However, one concern that arises when attempting to develop an online system which incorporates printing, slicing and cutting is the ability of a printer media advancement mechanism to direct the media through the printer without the media jamming or stopping after being cut or sliced. To avoid this difficulty, many known systems opt for an offline trimmer to create specialty-sized prints.

Offline trimmers, including offline cutters, which cut transversely to the media advancement direction, and offline slicers, which cut parallel to the media advancement direction, are alternative systems available to produce cleanly trimmed prints from a standard-sized media sheet. However, the cutters and slicers require additional steps in the production process as the printed media must first be manually removed by an operator from a printer and then input by the operator into the offline slicer and/or cutter. This process is not desired because the operator must first print the media, then slice the media, and finally, cut the media. Inaccuracies in cutting the prints are likely because each operation requires aligning the media sheet.

Integrated offline systems having both cutters and slicers are known, but consumer market products are simplistic in design. Known examples of consumer-available offline trimmers include hand-operated rotary trimmers or hand-operated guillotine cutters. These hand-operated systems, which are available to the consumer market, require manual alignment and positioning of the media, as well as manual operation of the slicer and/or cutter.

Commercial offline trimmers are also available. One type of known commercial trimmer employs an offline slicer, which has multiple blades to make a plurality of slices in a large media web. However, this type of slicer generally must be pre-set such that the media web is sliced continuously along the same lines. Hence, the blades that are engaged at the beginning of a print job remain engaged throughout the entire print job. Typically, these offline slicers are expensive and limited in their application.

In order to create different sized prints from a standard rolled media or media sheet, it would be desirable for the slicer to include blades that are independently actuable. One difficulty with such a flexible system, which allows a user to change the size of the prints on command, is the tendency for the system to crease the media sheet or print a blank media sheet as the system adjusts to the produce the desired print size. Commercial offline slicers are known which have employed a pneumatic actuator system that allows multiple round blades to be actuated simultaneously or intermittently by high-pressure air. However, such pneumatic systems are not practical for a small printer, due to the cost and size of the slicer.

What is needed is a low-cost, compact, flexible printer system, which includes an online cutter and slicer. By incorporating the cutter and slicer, specialty prints could be generated without the additional steps required when using an offline trimmer. However, to make the printer with cutter and slicer operations feasible for a small printer and consumer market, the printer must be relatively inexpensive to manufacture and to use. In addition, the printer may have a media advancement mechanism that directs the media along a media pathway after being cut or sliced. Finally, by providing a slicer with individually actuable blades, plural sizes could be created from a single rolled media or media sheet.

DISCLOSURE OF THE INVENTION

Briefly, the invention includes a printer for creating specialty-sized prints. The printer includes a media advancement mechanism, a printing mechanism, a cutter mechanism and a slicing mechanism. The advancement mechanism advances a media web or sheet through the printer in a media advancement direction. The printing mechanism is configured to print a desired-size print on the media. The cutter mechanism is operatively related to the printing mechanism, and is configured to cut the media transverse to the media advancement direction. The slicing mechanism is operatively related to the cutter mechanism and configured to slice the media parallel to the media advancement direction.

The slicing mechanism typically includes a plurality of cams positioned on a camshaft and a plurality of slicer modules positioned on a second shaft. Each slicer module typically has a contact spring and a blade. The contact spring of each such slicer module is operatively spaced from a cam associated with the respective slicer module. The blade of each such slicer module is operatively spaced from the media web or sheet.

An actuation mechanism may control the rotation of the camshaft such that the cams are positioned in either a contact or non-contact position. When in a contact position, the cams push against the contact spring of the slicer modules, thereby engaging the blade of the slicer module against the media web. The cams may be positioned in phase or out of phase so the slicer modules are actuated independently or simultaneously, depending on the desired print size.

The media advancement mechanism typically includes a plurality of rollers. Following printing by the print mechanism, an input roller typically is configured to drive the media web through the cutter mechanism and slicer mechanism. An output roller typically is positioned following the slicer mechanism so that the media is pulled through the slicer mechanism after being sliced.

DETAILED DESCRIPTION OF THE PREFERRED EMBODIMENT AND BEST MODE OF CARRYING OUT THE INVENTION

Figure 1:
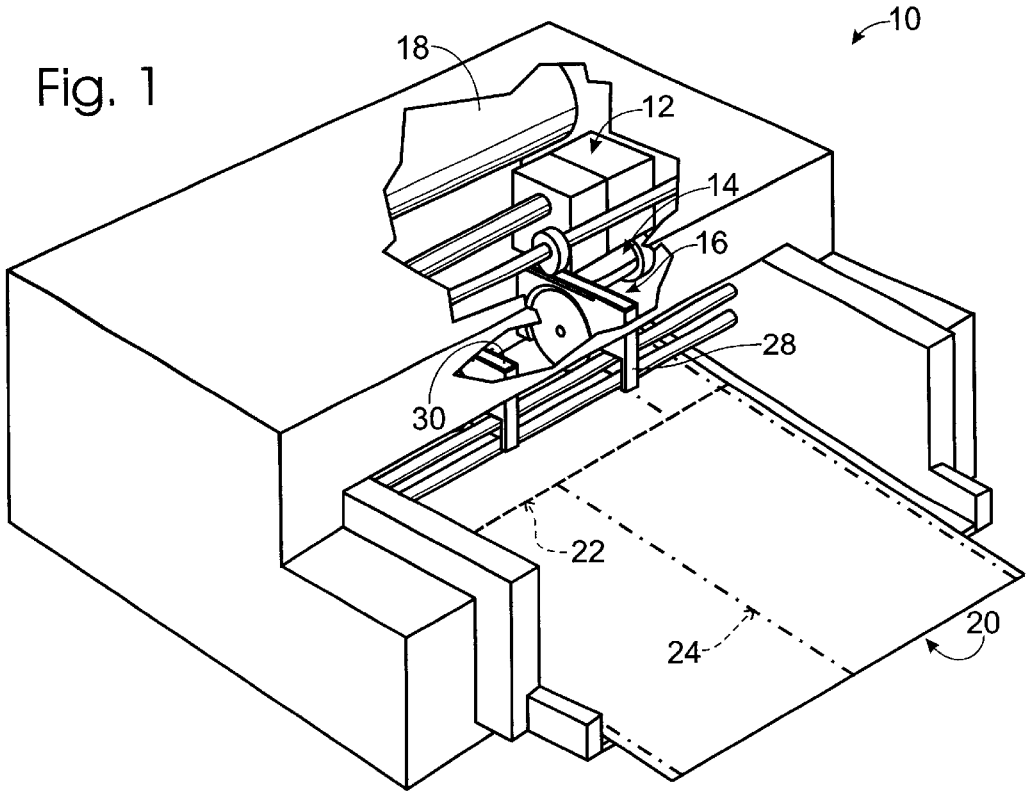
FIG. 1 is an isometric view of a printer constructed in accordance with the present invention.

Referring initially to FIG. 1, a printer is shown generally at 10, the printer including a fragmented view of a printing mechanism 12, a cutter mechanism 14 and a slicer mechanism 16. Standard media 18 is directed along a media pathway past printing mechanism 12, then past cutter mechanism 14 and finally through slicer mechanism 16. The resulting product of the printer is a printed output 20 of varying specialty-sized prints.

Printer 10 is a typical desktop printer. The invention is directed to small printers, however some commercial printers may be suitable as well. Moreover, printers of various sizes, for example B-sized desktop printers, are contemplated.

Media 18 may take the form of a media roll or web (as shown) or may be separate media sheets. The media roll may be of any size, however, a roll that allows optimal layout of the specialty-sized prints is desired. The roll size may depend on the printer used. For example, a typical desktop printer may require the use of an 8½-inch roll. The roll is fed directly into the printing mechanism, where a continuous stream of prints are printed. The stream of prints may then be cut and sliced to their appropriate sizes.

Media 18 may also be discrete media sheets of any size, as dictated by the size of the printer. The sheets, similar to the media roll, may be fed directly into the printing mechanism. Alternatively, the sheets may be created using a pre-print cutter, which cuts a continuous media web into discrete sheets prior to the media web reaching the printing mechanism. The cut media sheets are then fed into the printing mechanism.

Printing mechanism 12, as shown, includes two printheads of the type typically found in inkjet printers. Other types of printing mechanisms are contemplated, including, but not limited to, mechanisms for laser printers, electrophotographic printers, thermal-transfer printers, and liquid electro-photographic printers. Moreover, cutter mechanism 14 and slicer mechanism 16 may be used independently of the printing mechanism. Hence, a pre-printed media sheet may be fed directly into a cutter mechanism 14 and slicer mechanism 16 to create output 20. The combination of a cutter mechanism 14 and slicer mechanism 16 is referred to herein as a trimmer.

Still referring to FIG. 1, media 18 advances along the media pathway in a media advancement direction, which is parallel to a longitudinal axis of the media. Cutter mechanism 14 cuts media 18 transversely to the media advancement direction, as shown by a cut 22 in FIG. 1. All cuts are represented in the figures as dashed lines. Slicer mechanism 16 slices parallel to the media advancement direction, as shown by a slice 24. All slices are represented in the figures as dash-dot lines. As used herein, slicing refers to a shear made by the slicer mechanism parallel to media advancement.

Figure 1A:
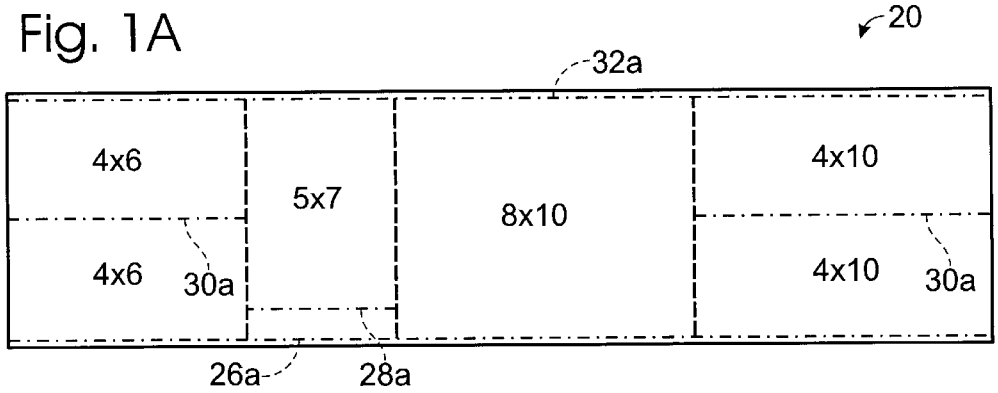
FIG. 1A is a media web showing plural cuts and slices performed by the printer shown in FIG. 1

Referring now to FIG. 1A, output 20 has been cut with cutter mechanism 14 and sliced with slicer mechanism 16 to form a number of different specialty-sized prints. In particular in the depicted output 20, two 4×6-inch prints, one 5×7-inch print, one 8×10-inch print and two 4×10-inch prints have been cut from an 8½-inch width media web. Other print sizes and combinations are possible depending on the arrangement of the slicer mechanism and the size of the media.

Figure 2:
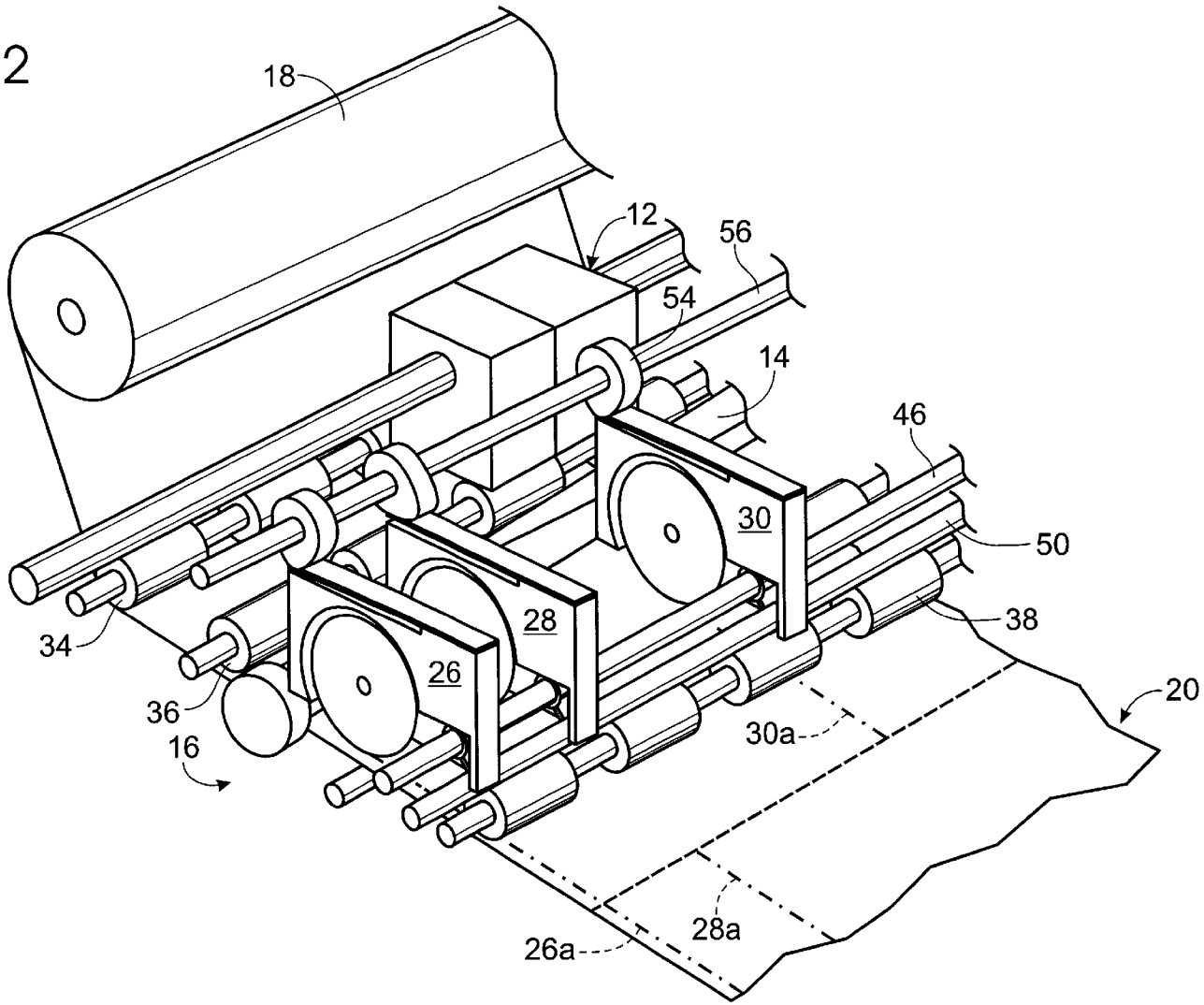
FIG. 2 is a fragmentary schematic representation of a media advancement mechanism, cutter mechanism and slicer mechanism of the printer shown in FIG. 1.
Figure 3:
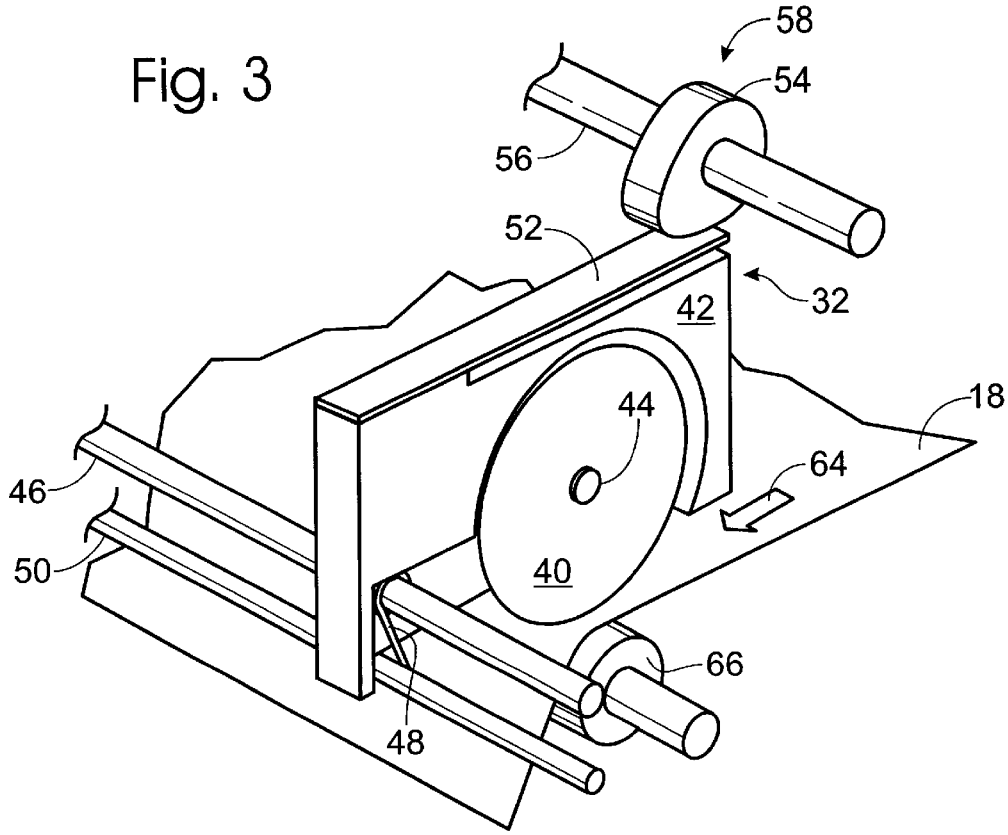
FIG. 3 is an isometric view of a slicer module of the slicer mechanism in a non-operable position.
Figure 4:
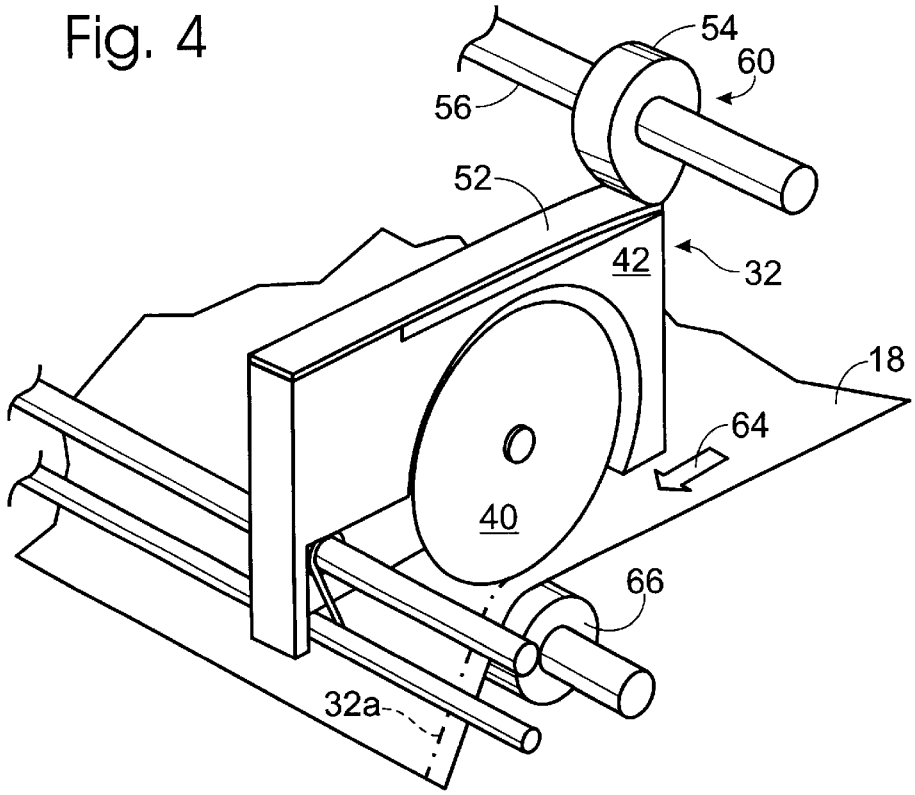
FIG. 4 is an isometric view of the slicer module of the slicer mechanism as shown in FIG. 3, but in an operable position.

The slicer mechanism, it will be appreciated, may include any number of slicer modules. The output shown in FIG. 1A was made with a slicer mechanism having four slicer modules, 26, 28, 30, and 32 as shown in FIGS. 2–4. Each slicer module is positioned at a transverse position to slice the media to an appropriate width or widths. The position of each slicer module may be adjustable or fixed. As shown in FIG. 2, left margin slice 26*a* is made by slicer module 26. Slicer module 28, shown in FIGS. 1 and 2, makes slice 28*a*. Slicer module 30, also shown in FIGS. 1 and 2, makes slice 30*a*. Slicer module 32, shown in FIGS. 3 and 4, makes right margin slice 32*a*.

By individually actuating the slicer modules the appropriate slices can be made in the media. For example, when slicer module 26 is actuated, then the associated slice 26*a* is created. Likewise when slicer module 28 is actuated, slice 28*a* is created. Similarly, actuation of slicer module 30 and 32 respectively create slices 30*a* and 32*a*.

The slicer modules also can be actuated simultaneously. Hence, in forming two 4×6-inch prints (shown in FIG. 1A), three slicer modules, 26, 30, and 32 are actuated together to slice the media along each side and in the middle of the media. Likewise, slicer modules 26, 30, and 32 are used in forming two 4×10-inch prints. The cutter mechanism is used to create transverse cuts (shown in dashed line) at the appropriate positions. A 5×7-inch print can be formed by actuating slicer module 28 and slicer module 32 simultaneously to form, respectively, slices 28*a* and 32*a*. In this configuration, slicer modules 28 and 32 are seven inches apart. The cutter mechanism is used to cut a five-inch block from the media. Likewise, the 8×10-inch print requires simultaneous actuation of slicer modules 26 and 32 to slice an 8-inch wide print. The cutter mechanism is used to cut a 10-inch length.

Referring to FIG. 2, the printer is shown in more detail. Roll media 18 is driven along the media pathway through a series of advancement mechanisms or rollers. The media is advanced by rotation of the rollers in a direction cooperative with the media advancement direction. The first set of rollers, shown at 36, advances the media past printing mechanism 12. The second set of rollers or input rollers 36 advance the media past cutter mechanism 14 and slicer mechanism 16. Output rollers 38 grab the media after the slicing and cutting operations to pull the media out of the printer. The three sets of rollers may be driven or undriven, and may be linked or may be independently operated, but typically are designed to keep media 18 taught.

As shown, the cutter mechanism and slicer mechanism operate by the combined operation of the input and output rollers. The media is not cut until the output roller grips the first edge of the media. The rollers, which may be conventional rubber rollers, are generally on shafts driven by individual stepper motors (not shown) or other types of motors. However, the shafts may be coupled and driven together by a single motor.

The overall printing system operates such that a user defines the size and quantity of prints. The printing system includes a processor (not shown), which coordinates the system and controls the motors to produce the desired output. For example, after the printing operation, input rollers 36 are directed by the processor to advance the media into the cutter mechanism. The media motion may then be stopped such that the cutter mechanism cuts the media to the desired length. The cut section is then gripped by output rollers 38 and a slicer drum 66 (shown in FIGS. 3 and 4, and discussed below) and directed through the slicer mechanism and out of the printer. The processor controls the process by directing the motor associated with each roller.

In the depicted embodiment, the input rollers direct the media into cutter mechanism 14. Cutting prior to slicing results in clean cuts and prevents nicks, or partially cut regions, in the media. Cutter mechanism 14, as best illustrated in FIG. 2, is a rotary cutter positioned upstream from the slicer mechanism. It will be appreciated, however, that cutter mechanisms may be placed both downstream and upstream from the slicer mechanism. The depicted rotary cutter includes a blade wrapped around a cylinder, which rotates against a second stationary blade. These cutter mechanisms are generally driven by an electric motor (not shown) and are typically compact and safe. One suitable cutter mechanism would be an electric rotary auto cutter made by Hecon Corporation. However other types of cutter mechanisms are contemplated, including but not limited to, translational cutters, traveling knife cutters and guillotine cutters.

After advancing through cutter mechanism 14, the media is directed by output rollers 38 to slicer mechanism 16. Slicer mechanism 16, as explained previously, may include a plural number of slicer modules. However, other slicers mechanisms which have individually actuable blades are also contemplated. In the depicted slicer mechanism, three slicer modules, 26, 28, 30, are shown in FIG. 2 and a fourth slicer module, 32, is shown in FIGS. 3 and 4. Any number of slicer modules may be utilized.

Turning attention to FIG. 3, the slicer modules can be more readily understood. Each slicer module includes a blade 40 and a blade holder 42. In operation, the media passes between blade 40 and a rotary slicer drum 66. As the media advances, along media pathway 64, the blade is pushed against the rotary drum causing a crushing shear of the media and hence, slices the media. The slice drum may be electrically driven such that as it rotates, the media is fed by input rollers and drawn through the blades by output rollers and slicer drum 66. In addition, slicer drum 66 may include slots (not shown) to receive pre-positioned slicer blades. The slicer modules would then have pre-set positions such that the blades could align with the slots in the slicer drum. However, a smooth rotary drum could also be used which would allow the slicer modules to be manually or electrically positioned at any location along the width of the media.

Blade 40, as shown, is a circular or round blade, but other blades may be used. The blade is coupled to the blade holder with a hub 44, which may be any type of locking bolt or screw adapted to couple the blade to the blade holder.

As shown, only one blade is employed per blade holder. However, it is contemplated that more than one blade may be used in a single blade holder or that blade holders may be located adjacent to each other. By using plural blades in a single blade holder, slight paper alignment errors may be eliminated and clean prints produced because adjacent prints each have a small sliver removed from them. By removing a sliver from each print, it is possible to eliminate overlap of the pictures due to misalignment of the media sheet. Similarly, by using adjacent blade holders, the misalignment may also be corrected.

Blade holder 42 is a support structure for blade 40. Blade holder 42 is positioned on a blade holder shaft 46 which may support a plural number of blade holders. The blade holders may be spring loaded to maintain the blade holder in a first or non-slicing position. In the depicted embodiment, a torsion spring 48 is shown which maintains the position of the blade holder on blade holder shaft 46. The torsion spring may be secured by a rod 50 or may rest on another surface. Torsion spring 48 biases blade holder 42 toward a non-operable position, where the associated blade does not contact or slice the media sheet or web. A collar, screw or similar device (not shown) may be attached to the blade holder shaft to secure blade holder 42 in place. Blade holder/cam pairs also may be laterally adjusted to accommodate creation of different size prints.

Blade holder 42 includes a flat spring or leaf spring 52. The leaf spring, also referred to herein as a contact spring, is operatively configured for contact by a cam 54. The spring bias of blade holder 42 may be overcome by compression of leaf spring 52 such that the blade holder rotates to position the associated blade in a slicing or operative position, but allows for some play in the slicing position of the blade. On blade holder 42, shown in FIG. 3, the leaf spring is on the upper surface of blade holder 42, but other arrangements may be possible.

Cam 54 is positioned on rod or camshaft 56 which is driven by a motor (not shown). The motor may be a stepper motor, DC motor with an encoder, or other functionally similar motor. The stepper motor or other type of motor drives the camshaft such that there can be individual actuation of the slicer modules. The camshaft is rotated such that the cam pushes against blade holder 42 with sufficient force to drive blade 40 to contact slicer drum 66. Once the motor increments the shaft such that cam 54 does not have sufficient contact force against blade holder 42, torsion spring 48 rotates the blade holder and associated blade from the media allowing the media to pass by unsliced.

The cam is generally oblong or pear-shaped having a tapered side which with rotation of the camshaft pushes against the leaf spring to engage the blade to slice the media. Because of the shape of cam 54, rotation of camshaft allows cam 54 to intermittently contact the leaf spring of blade holder 42.

As shown in FIG. 3, cam 48 is in a non-contact position 58, where the slicer module is not actuated, and hence, the blade does not slice the media as it is advanced past the slicer mechanism. In contrast, in FIG. 4, cam 54 is in an operable contact position 60 where cam 54 presses on leaf spring 52 such that blade holder 42 pivots slightly to engage blade 40 against media 18, thereby slicing the media parallel to the media advancement direction 64. The blade slices the media sheet or web as it is advanced along the media pathway.

Since the media is interposed blade 40 and rotating slicer drum 66, as the blade holder is pivoted, blade 40 impinges on slicer drum 66. The media is is sandwiched between the blade and the slicer drum, and as a result, is sliced. When cam 54 is rotated back to a non-contact position, the blade holder is released and is biased back to the non-operable position where the blade is spaced from the media and the media may pass through slicer module 32 unsliced, as shown in FIG. 3.

Returning to FIG. 2, multiple slicer modules may be positioned along blade holder shaft 46 with a respective actuation cams 54 positioned respectively on camshaft 56. Each slicer module has a respectively aligned cam that may be operatively positioned such that it contacts the blade holder of each slicer module. The cams may be identically shaped but positioned differently or offset on the shaft such that, at different rotation positions of the shaft, different cams are in the contact and non-contact positions. For example, the cams may be positioned in phase such that rotation of camshaft 56 actuates multiple slicer modules. Such in-phase positions are shown in FIG. 2 where slicer modules 26 and 30 are actuated simultaneously. Alternatively, the cams may be positioned out of phase such that rotation of camshaft 56 actuates individual slicer modules separately. As an illustration, in FIG. 2, slicer module 28 and its respective cam are not actuated simultaneously with slicer modules 26 and 30. However, as shown in output 20, cut 28*a* is made simultaneously with cut 26*a,* indicating that slicer modules 26 and 28 are in phase with each other.

Cams in the same slicer mechanism may be shaped differently. Some cams may have multiple lobes or variably sized lobes. Alternatively, some cams may be identical. Multiple lobes may cause the associated blade holder to be activated more often then a blade holder with a single lobed cam. By changing the spacing of the lobes and the number of lobes, many variations in print sequences may be possible. In addition, the size of the lobes may be used to dictate the duration of actuation of the blade holder.

A processor controls the slicer mechanism in the printer. For example, when a user defines a desired print quantity and size, the processor then directs the media advancement mechanism to drive the media through the system. In addition, the processor directs the actuation of a motor which drives the camshaft. The camshaft is then rotated to position the cams in the appropriate positions to actuate the blade holders and respective blades as needed to create the desired size print. The media is advanced through the slicer mechanism by the processor that also drives a motor which controls the output rollers 38 and slicer drum 66. After slicing the media, the camshaft motor is again directed by the processor to reposition for a second print. It will be appreciated that the camshaft and input/output rollers may be driven by a single motor using appropriate clutch/gear mechanisms.

Returning to FIG. 1A, it will be appreciated that in creating output 20, the edge slicer modules, 26 and 32, may have cams which are continuously engaged and are in phase such that there is constant actuation throughout the entire output. However, slicer modules 28 and 30 may be selectively actuable with the associated cams intermittently out of phase. Hence, with slicer modules 28 and 30, the cams are in either the contact or non-contact position. When the slicer module is in the contact position, the cam engages the blade holder and associated blade to slice the media and when the slicer module is in the non-contact position, the cam is disengaged from the blade holder and the media passes through the slicer module unsliced. The processor in this output drives the camshaft motor such that the camshaft positions the cams to selectively actuate slicer modules 28 and 30, and to consistently actuate slicer modules 26 and 32. Similarly, it will be understood that some slicer modules (e.g. slicer modules 28 and 30) may be actuated independently of other slicer modules (e.g. slicer modules 26 and 32) to accommodate selected overlapping slicer module operation.

The user can change the print size on demand in the depicted printing system. A change in the print size does not cause a resultant crease in the media sheet. Nor does a change in the print size require a blank sheet to be printed prior to the change. In contrast, the above-described printing system allows for an uninterrupted variably-sized printed output.

As explained previously, the printer is a driven system. The print mechanism, cutter mechanism, slicer mechanism and media advancement mechanisms are all driven. Moreover, the depicted embodiment uses a stepper motor to drive the camshaft of the slicer mechanism. The blades of the slicer modules may also be driven.

A sensor or detector (not depicted) may be used following the printing mechanism. The sensor detects the printed image size and signals the cutter mechanism and slicer mechanism to cut and slice the prints to the appropriate size.

Additionally, the printer may include a collator or stacker positioned after the slicer mechanism. This collator may sort the prints as directed to provide a more orderly output. Moreover, any scrap material produced by the printer may be discharged with the print output or may be redirected to a collection receptacle attached to the printer. The collection receptacle may also be positioned below the printer such that scrap material simply falls into the receptacle as the prints are sorted by the collator.

Accordingly, while the present invention has been shown and described with reference to the foregoing preferred embodiments, it will be apparent to those skilled in the art that other changes in form and detail may be made therein without departing from the spirit and scope of the invention as defined in the appended claims.

We claim:

1. A desktop printer for creating specialty-sized prints where media is advanced through the printer in a single media advancement direction, the printer comprising:

a housing;

a printing mechanism disposed in the housing and configured to place a desired print on the media;

a cutter mechanism disposed in the housing adjacent the printing mechanism and configured to cut the media transverse to the media advancement direction; and a slicing mechanism disposed in the housing adjacent the printing mechanism and configured to cut the media parallel to the media advancement direction.

2. The printer of claim 1, wherein the slicing mechanism includes a slicer module having a blade configured to selectively engage advancing media, and an actuation mechanism configured to rotate a cam to push against a contact spring of the slicer module thereby urging the blade into contact with the advancing media.

3. The printer of claim 2, wherein the blade is a circular blade.

4. The printer of claim 2, wherein the contact spring and blade are contained within a blade holder.

5. The printer of claim 2, wherein the acutation mechanism further includes a motor configured to drive the cam.

6. The printer of claim 5, wherein the motor is a stepper motor.

7. The printer of claim 1, further comprising a media advancement mechanism having a plurality of electrically driven rollers.

8. The printer of claim 1, wherein the printer is an inkjet printer.

9. The printer of claim 1, wherein the printer is an electro-photographic printer.

10. The printer of claim 1, wherein the printer is a thermal-transfer printer.

11. The printer of claim 1, wherein the printer is a liquid electro-photographic printer.

12. The printer of claim 1, wherein the cutter mechanism is a rotary cutter.

13. The printer of claim 1, wherein the cutter mechanism is a translational cutter.

14. The printer of claim 1, wherein the cutter mechanism is a guillotine cutter.

15. A printer for creating specialty-sized prints where media is advanced through the printer in a media advancement direction, the printer comprising:

a printing mechanism configured to place a desired print on the media;

a cutter mechanism configured to cut the media transverse to the media advancement direction; and a slicing mechanism configured to cut the media parallel to the media advancement direction, wherein the slicing mechanism includes a slicer module having a blade configured to selectively engage advancing media, and an actuation mechanism configured to rotate a cam to push against a contact spring of the slicer module thereby urging the blade into contact with the advancing media, wherein the contact spring is a leaf spring.

16. A media trimmer for a printer, comprising:

an input roller for driving media through the printer along a media pathway;

a cutter mechanism positioned along the media pathway to cut media received from the input roller;

a slicer mechanism adjacent the cutter mechanism along the media pathway, the slicer mechanism being positioned to slice media after the cutter mechanism; the slicer mechanism having at least a first cam and a second cam on a common camshaft, and at least a first slicer module and a second slicer module, corresponding to the first cam and second cam respectively, the first slicer module being interposed the first cam and the media and the second slicer module being interposed the second cam and the media, such that each slicer module is selectively individually actuable upon rotation of the camshaft;

an output roller configured to pull the media from the slicer mechanism; and a motor configured to position the camshaft such that the first cam is in a contact position and the second cam is in a non-contact position, where in the contact position the first slicer module engages and slices media and where in the non-contact position the second slicer module does not engage media.

17. The trimmer of claim 16, wherein the cutter mechanism is a rotary cutter.

18. The trimmer of claim 16, wherein the slicer mechanism includes a drive drum operatively spaced from the slicer modules and positioned to advance the media to the output roller.

19. The trimmer of claim 16, wherein each slicer module is pivotal between an operative position wherein media is sliced as it advances to the output roller and a non-operative position wherein media advances unsliced to the output roller.

20. The trimmer of claim 16, wherein each slicer module has a blade holder comprising a blade and a contact spring, such that rotation of the camshaft selectively actuates each cam to push against the contact spring of the respective blade holder, thereby biasing each blade holder such that the blade is urged into contact with media.

21. The trimmer of claim 16, wherein the first and second cam are identically shaped.

22. The trimmer of claim 16, wherein the first and second cam have multiple lobes.

23. A media trimmer for a printer, comprising:

an input roller for driving media through the printer along a media pathway;

a cutter mechanism positioned along the media pathway to cut media received from the input roller;

a slicer mechanism adjacent the cutter mechanism along the media pathway, the slicer mechanism being positioned to slice media after the cutter mechanism; the slicer mechanism having at least a first cam and a second cam on a common camshaft, and at least a first slicer module and a second slicer module, corresponding to the first cam and second cam respectively, the first slicer module being interposed between the first cam and the media and the second slicer module being interposed between the second cam and the media, such that each slicer module is selectively individually actuable upon rotation of the camshaft;

an output roller configured to pull the media from the slicer mechanism; and a motor configured to position the camshaft such that the first cam is in a contact position and the second cam is in a contact position, where in the contact position the first slicer module and second slicer module simultaneously engage and slice the media in two positions.

24. A media slicer mechanism for a printer comprising:

a media advancement mechanism adapted to direct a media web through the slicer mechanism;

a plurality of cams on a common shaft, where at least one of the cams is selectively positioned such that rotation of the common shaft aligns the at least one cam in a contact position;

a motor attached to the common shaft configured to move the at least one cam between the contact position and a non-contact position;

a plurality of blade holders interposed between the plurality of cams and the media web, where at least one blade holder has a blade and a contact spring, where when the at least one cam is in the contact position, the at least one cam engages the contact spring of the at least one blade holder which is actuated to slice the media web.

* * * * *